United States Patent [19]

Kenmochi

[11] Patent Number: 5,044,248

[45] Date of Patent: Sep. 3, 1991

[54] GERMAN BASSOON EQUIPPED WITH IMPROVED PIANISSIMO KEY MECHANISM

[75] Inventor: Hiroshi Kenmochi, Shizuoka, Japan

[73] Assignee: Yamaha Corporation, Hamamatsu, Japan

[21] Appl. No.: 602,613

[22] Filed: Oct. 24, 1990

[30] Foreign Application Priority Data

Oct. 27, 1989 [JP] Japan ..... 1-281290

[51] Int. Cl.[5] ..... G10D 7/06

[52] U.S. Cl. ..... 84/380 A

[58] Field of Search ..... 84/380

[56] References Cited

U.S. PATENT DOCUMENTS

| | | | |
|---|---|---|---|
| 3,142,222 | 7/1964 | Polisi | 84/380 A |
| 3,850,071 | 11/1974 | Paladino | 84/380 A |
| 3,890,874 | 6/1975 | Vedder | 84/384 |
| 4,376,403 | 3/1983 | Haedrich et al. | 84/384 |

*Primary Examiner*—Lawrence R. Franklin

*Attorney, Agent, or Firm*—Burns, Doane, Swecker & Mathis

[57] ABSTRACT

A German bassoon comprises a crook, other component joints connected to the crook and a pianissimo key mechanism closing a pianissimo hole formed in the crook without any keywork, and the pianissimo key mechanism allows the pianissimo hole to be open when a player manipulates, thereby causing a performance of the German bassoon to be easy.

7 Claims, 5 Drawing Sheets

GERMAN BASSOON EQUIPPED WITH IMPROVED PIANISSIMO KEY MECHANISM

FIELD OF THE INVENTION

This invention relates to a bassoon and, more particularly, to a pianissimo key incorporated in the German bassoon.

DESCRIPTION OF THE RELATED ART

A typical example of the German bassoon is illustrated in FIG. 1 and has five essential parts, i.e. a crook 1, a wing joint 2, a butt 3, a long joint 4 and a bell joint 5. The crook 1 is implemented by a curved brass tube and provides an air passageway from a lead unit 6 to the wing joint 2. The wing joint 2, the butt 3, the long joint 4 and the bell joint 5 are of wood such as, for example, European maple and form an air column therein. The German bassoon has twenty-five to twenty-eight tone holes, and twenty-nine to thirty-three keys are provided in association with the tone holes. One of the tone holes is formed in the crook 1 and assigned to a keywork for pianissimo or production of a soft sound. A key mechanism 7 is provided in association with the tone hole formed in the crook 1, and the tone hole and the associated key mechanism 7 are hereinbelow referred to as "pianissimo hole" and "pianissimo key mechanism", respectively.

The pianissimo key mechanism 7 comprises a tampon *7a* which normally allows the pianissimo hole to be open by the aid of a leaf spring. When a whisper key or a pianissimo key *7b* is depressed, the tampon *7a* moves against the resilient force of the leaf spring and closes the pianissimo hole. The pianissimo key *7b* is provided on the wing joint 2 and depressed by the left thumb of a player.

FIG. 2 illustrates a prior art link mechanism between the pianissimo key *7b* and the tampon *7a* in detail. The pianissimo key *7b* is coupled to the leading end of a key arm *7c*, and the key arm *7c* is connected to a key pin *7d*. The key pin *7d* is rotatable with respect to the wing joint 2. The key pin *7d* further has a key arm *7e*, and the key arm *7e* is held in contact with a key arm *7f* at all times. The key arm *7f* transmits the motion of the key arm *7e* to a key arm *7g*, and the key arm *7g* is connected to a key pin *7h*. The key pin *7h* is rotatable with respect to the wing joint 2. Two key arms *7i* project from the key pin *7h*, and a rod member *7j* is fixedly supported by the two key arms *7i*. To the leading end of the rod member *7j* is connected a key arm *7k* which supports the tampon *7a*. Though not shown in the drawings, the leaf spring urges the tampon *7a* to turn in the counter-clockwise direction (indicated by arrow 71) at all times, thereby allowing the tampon *7a* to open the pianissimo hole. If the left thumb of a player depresses the pianissimo key *7b*, the key pin *7d* turns in the counter-clockwise direction, and the key arm *7e* lifts the key arm *7f*. The key arm *7f* causes the key arm and, accordingly, the key pin *7h* to turn in the clockwise direction, and the key arms *7i* and, accordingly, the rod member *7j* are downwardly moved toward the wing joint 2. Then, the tampon turns in the clockwise direction and closes the pianissimo hole. However, if the pianissimo key *7b* is released, the leaf spring urges the tampon *7a* to recover the initial position. A locking key *7m* is provided in association with the pianissimo key *7b* and maintains the pianissimo key *7b* in the depressed state. The locking key *7m* is implemented by a two-stable cam mechanism formed between the bottom surface of the key *7m* and the surface of the wing joint 2.

While playing the German bassoon, the left thumb is the busiest of all and covers the widest range of the key arrangement. In fact, seven to eleven keys are selectively depressed while tones in the middle note range are produced. The compass of the bassoon is usually three octaves upward from the Bb (B flat) keywork for the left thumb concerns most of the tones except for the small number of tones. Although usage of the pianissimo key follows the philosophy of a player, the pianissimo hole is generally closed while the player produces the tones in the middle note range, but is open for most of the tones in the higher range. Moreover, the pianissimo key is closed again while the G or Gis is requested. Thus, the pianissimo key *7b* is depressed by the left thumb or locked with the locking key *7m* for producing the tones in the middle note range and some tones in the higher note range.

Several keys are selectively depressed by the left thumb for producing the tones in the middle note range, and the pianissimo key mechanism 7 should close the pianissimo hole while the German bassoon produces the tones in the middle note range. It is impossible for the left thumb to concurrently depress the pianissimo key *7b* and the other keys. In order to cope with such a difficulty, the player locks the pianissimo key *7b* and depresses the other keys for producing the tones in the middle note range.

However, a problem is encountered in the prior art German bassoon in that the player frequently locks and releases the pianissimo key *7b* with the locking key *7m* while a melody to be performed runs on the middle and upper note ranges. If the melody is produced at a slow tempo, the keywork of the locking key *7m* may be responsive; however, a melody at a fast tempo makes the keywork of the locking key *7m* difficult. Some professional players may cope with the difficulty by substituting another finger for the left thumb, but ordinary players hardly employ such a solution for themselves.

As well known to a person skilled in the art, the key mechanisms of the German bassoon is quite different from those of a French bassoon. If a player replaces the French bassoon with the German bassoon, the pianissimo hole is usually closed and sometimes opened in a performance. The usage is supported by the locking key, or the player continues to depress the pianissimo key while other keys are manipulated. Such a difficult keywork provides a high barrier against a beginner and makes a student hesitate to learn the bassoon.

SUMMARY OF THE INVENTION

It is therefore an important object of the present invention to provide a German bassoon which is easy for performance.

To accomplish the object, the present invention proposes to close a pianissimo hole without any keywork.

In accordance with the present invention, there is provided a German bassoon comprising a) a tube member having a crook and a series combination of component joints connected to the crook, a pianissimo hole being formed in the crook, and b) a pianissimo key mechanism closing the pianissimo hole without any manipulation and allowing the pianissimo hole to be open when a player manipulates the pianissimo key mechanism.

BRIEF DESCRIPTION OF THE DRAWINGS

The features and advantages of a German bassoon according to the present invention will be more clearly understood from the following description taken in conjunction with the accompanying drawings in which.

DESCRIPTION OF THE PREFERRED EMBODIMENT

Figure 1:
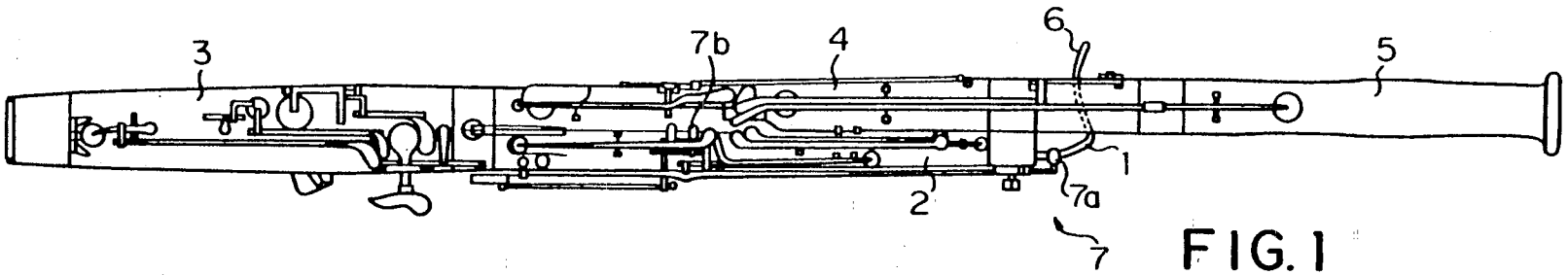
FIG. 1 PRIOR ART
FIG. 1 is a front view showing the overall structure of a prior art German bassoon.
Figure 2:
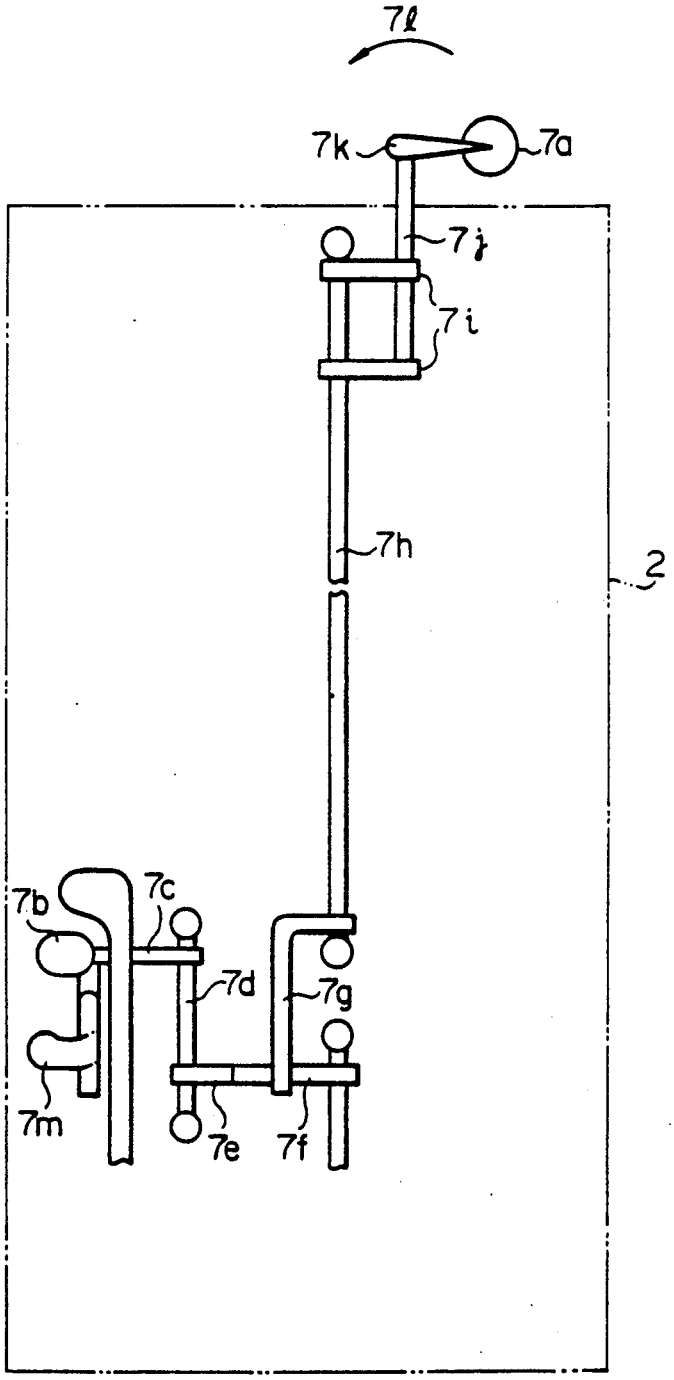
FIG. 2 PRIOR ART
FIG. 2 is a view showing the arrangement of a pianissimo key mechanism incorporated in the prior art German bassoon.
Figure 3:
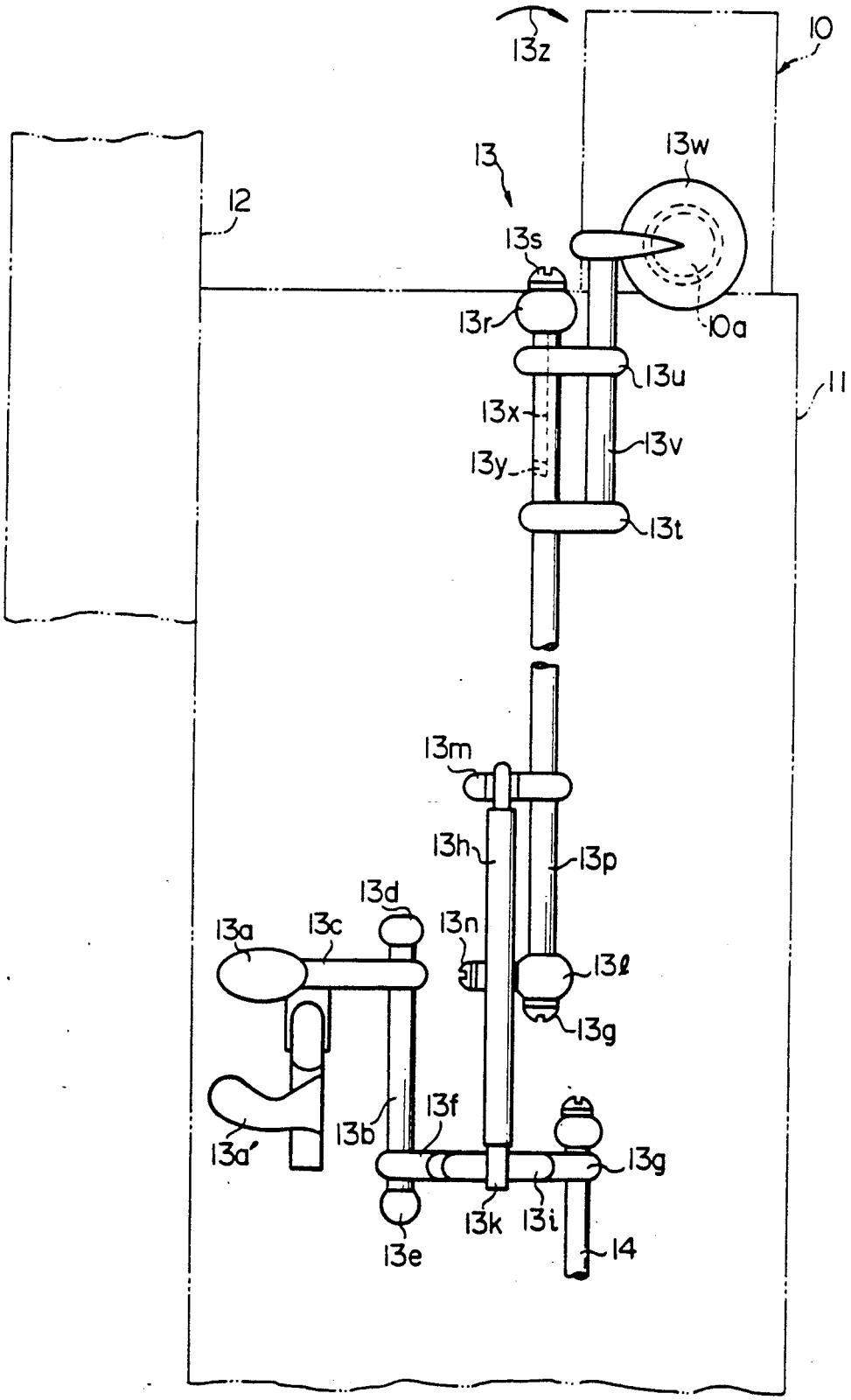
FIG. 3 is a view showing the arrangement of a pianissimo key mechanism incorporated in a German bassoon according to the present invention.

The overall structure of a German bassoon according to the present invention is similar to that of the prior art German bassoon shown in FIG. 1 except for a pianissimo key mechanism and, accordingly, has five essential parts, i.e. a crook, a wing joint, a butt, a long joint and a bell joint. Referring to FIG. 3, only the crook, the wing joint and the long joint are designated by reference numerals 10, 11 and 12, respectively.

Figure 4:
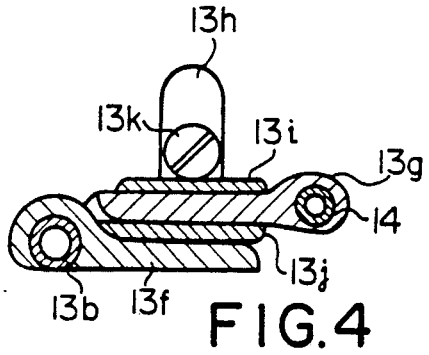
FIG. 4 is a sectional view showing the arrangement around a connecting arm incorporated in the pianissimo key mechanism.

In the crook 10 is formed a pianissimo hole 10*a* which is selectively opened and closed with a pianissimo key mechanism 13. The pianissimo key mechanism 13 comprises a pianissimo key 13*a* coupled to a key tube 13*b* by means of a key arm 13*c*, and the key tube 13*b* is rotatablly supported by a pair of key columns 13*d* and 13*e* so as to allow the pianissimo key 13*a* to angularly move with respect to the key columns 13*d* and 13*e*. The key columns 13*d* and 13*e* are fixed to the wing joint 11, and, for this reason, the pianissimo key 13*a* is angularly moved with respect to the wing joint 11. A connecting arm 13*f* is connected to the opposite end of the key tube 13*b*, and the connecting arm 13*f* is engaged with a connecting arm 13*g*, and the connecting arm 13*g* transmits the motion of the connecting arm 13*f* to not only another key mechanism 14 but also a transmission bar 13*h*. As will be better understood from FIG. 4, pieces of cork 13*i* and 13*j* are respectively inserted between a roller 13*k* of the transmission bar 13*h* and the connecting arm 13*g* and between the connecting arms 13*g* and 13*f*.

Figure 5:
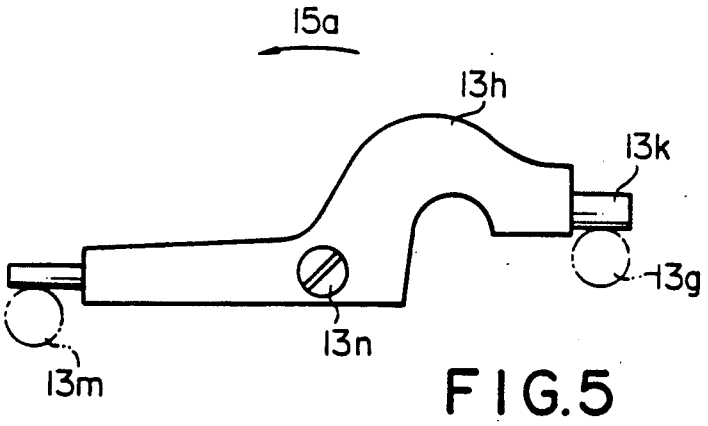
FIG. 5 is a front view showing the arrangement around a transmission bar incorporated in the pianissimo key mechanism.
Figure 6:
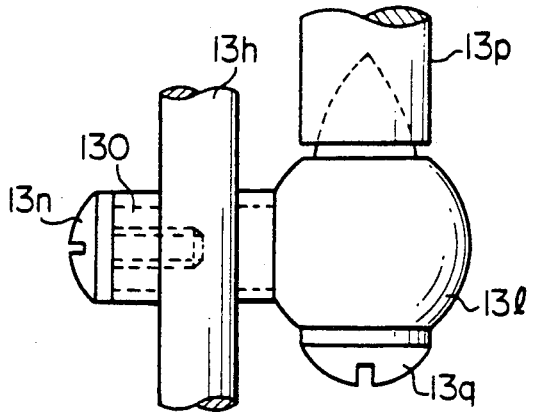
FIG. 6 is a view showing, in an enlarged scale, the arrangement a joint between the transmission bar and a key column.
Figure 7:
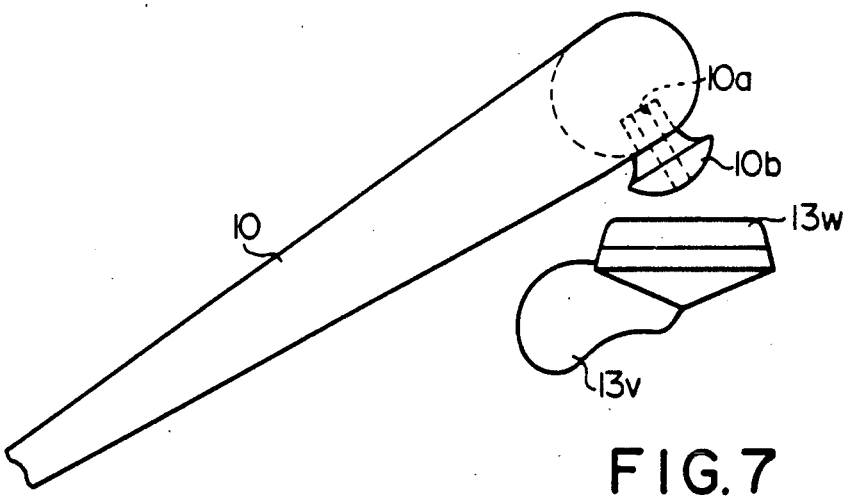
FIG. 7 is a view showing a pianissimo hole and a tampon incorporated in the pianissimo key mechanism.

Turning back to FIG. 3 of the drawings, the transmission bar 13*h* is swingable with respect to a key column 131. Namely, the transmission bar 13*h* has both end portions different in level one of which supports the roller 13*k* and the other of which provides a projection held in contact with a connecting arm 13*m*. The intermediate portion of the transmission bar 13*h* is supported by a pin 13*n* (see FIG. 5), and the pin 13*n* provides a center axis of the swinging motion. As will be better seen from FIG. 6, the pin 13*n* is screwed into a supporting block 13*o*, and the leading end portion of the pin 13*n* is inserted into the transmission bar 13*h*. The supporting block 13*o* is brazed to the key column 131, and the key column 131 is fixed to the wing joint 11. Thus, the transmission bar 13*h* is swingable with respect to the key column 131 and, accordingly, to the wing joint 11. The key column 131 supports a key pin 13*p* by means of a pivotal screw 13*q*, and the other end of the key pin 13*p* is also supported by a key column 13*r* by means of a pivotal screw 13*s* (see FIG. 3). Thus, both ends of the key pin 13*p* are respectively held in contact with the pivotal screws 13*q* and 13*s*, and, for this reason, the key pin 13*p* is capable of rotation around the center axis thereof. The connecting arm 13*m* is fixed to the key pin 13*p* closer to the key column 131 than the key column 13*r*, and a pair of arms 13*t* and 13*u* project from the key pin 13*p* in the vicinity of the key column 13*r*. An inverted L-shaped connecting member 13*v* is supported by the arms 13*t* and 13*u*, and a tampon 13*w* is attached to the connecting member 13*v*. As will be understood from FIG. 7, a boss member 10*b* is planted in the crook 10, and the pianissimo hole 10*a* is formed in the boss member 10*b*. The pianissimo hole 10*a* is selectively closed and opened with the tampon 13*w*, and the open pianissimo hole 10*b* imparts a pianissimo effect to a tone. In this instance, when the tampon 13*w* is moved into a first position, the pianissimo hole 10*a* is closed; however, the pianissimo hole 10*a* is open in a second position of the tampon 13*w*.

The pianissimo key mechanism 13 according to the present invention further has a leaf spring 13*x*, and the leaf spring 13*x* is held in contact to an anchor portion 13*y* formed in the key pin 13*p*. The leaf spring 13*x* urges the key pin 13*p* to rotate in the clockwise direction (indicated by arrow 13*z*), and, accordingly, the tampon 13*w* stays in the first position by the aid of the leaf spring 13*x* without any keywork of a player. A locking key 13*a'* is provided in association with the pianissimo key 13*a*. When the locking key 13*a'* is depressed, the locking key 13*a'* maintains the pianissimo key 13*a* to stay in a depressed state even though the player releases the locking key 13*a'*. However, if the player causes the locking key 13*a'* to return, the pianissimo key 13*a* also returns the initial position thereof. Thus, the locking key 13*a'* achieves a two-stable action.

Description is hereinbelow made on the function of the pianissimo key mechanism 13. As described hereinbefore, while the player does not depress the pianissimo key 13*a*, the tampon 13*w* stays in the first position and closes the pianissimo hole 13*a*. If the player depresses the pianissimo key 13*a*, the key arm 13*c* and, accordingly, the key tube 13*b* are driven for rotation in the counter clockwise direction, and the connecting arm 13*f* lifts the connecting arm 13*g* and the roller 13*k*. The transmission bar 13*h* swings in a direction indicated by arrow 15*a* (see FIG. 5) and presses the connecting arm 13*m*. The connecting arm 13*m* thus pressed causes the key pin 13*p* to rotate in the counter clockwise direction against the leaf spring 13*y*, and the tampon 13*w* moves from the first position to the second position, thereby allowing the pianissimo hole 10*a* to be open.

The tampon 13*w* stays in the second position in so far as the player depresses the pianissimo key 13*a*. However, when the player releases the pianissimo key 13*a*, the leaf spring 13*x* causes the tampon 13*w* to return the first position. The pianissimo key mechanism 13 according to the present invention allows the tampon 13*w* to be close without any keywork, and, for this reason, the player easily performs a melody running on the middle and upper note ranges.

As will be understood from the foregoing description, the German bassoon equipped with the pianissimo key mechanism according to the present invention is easy for performance rather than the prior art German bassoon.

Although particular embodiments of the present invention have been shown and described, it will be obvious to those skilled in the art that various changes and modifications may be made without departing from the spirit and scope of the present invention. For example, the leaf spring may be replaced with another kind of elastic member.

What is claimed is:

1. A German bassoon comprising a) a tube member having a crook and a series combination of component joints connected to the crook, a pianissimo hole being formed in said crook, and b) a pianissimo key mechanism closing said pianissimo hole without any manipulation and allowing said pianissimo hole to be open when a player manipulates said pianissimo key mechanism.

2. A German bassoon as set forth in claim 1, in which said pianissimo key mechanism is supported by a wing joint forming a part of said series combination of component joints.

3. A German bassoon as set forth in claim 2, in which said pianissimo key mechanism has a tampon movable between first and second positions, and an elastic member urging said tampon to said first position, said tampon closing said pianissimo hole in said first position, said tampon allowing said pianissimo hole to be open in said second position.

4. A German bassoon as set forth in claim 3, in which said pianissimo key mechanism further has a pianissimo key and a link mechanism coupled between said pianissimo key and said tampon, and in which said pianissimo key causes said tampon to move in said second position while being manipulated.

5. A German bassoon as set forth in claim 4, in which said pianissimo key mechanism further has a locking key for maintaining said pianissimo key in a manipulated state.

6. A German bassoon as set forth in claim 4, in which said link mechanism comprises a key arm interconnecting said pianissimo key and a key pin rotatablly supported by a pair of key columns, a connecting arm coupled to said key pin, a transmission bar swingable with respect to another pair of key columns for transmitting a motion of said connecting arm to another key pin rotatablly supported by said another pair of key columns, and a connecting member supported interconnecting said another key pin and said tampon.

7. A German bassoon as set forth in claim 6, in which said elastic member is implemented by a leaf spring.

* * * * *